US006021908A

United States Patent [19]

Mathews

[11] Patent Number: 6,021,908

[45] Date of Patent: Feb. 8, 2000

[54] EXTENSIBLE DISPLAY SHELF

[75] Inventor: Roger W. Mathews, Gnadenhutten, Ohio

[73] Assignee: Tusco Limited Partnership, Gnadenhutten, Ohio

[21] Appl. No.: 08/888,591

[22] Filed: Jul. 7, 1997

[51] Int. Cl.[7] ..... A47F 5/08; A47F 5/00

[52] U.S. Cl. ..... 211/90.2; 211/175; 211/153

[58] Field of Search ..... 211/175, 153, 211/90.02; 108/137, 143, 65, 69; 403/109.3

[56] References Cited

U.S. PATENT DOCUMENTS

| | | | |
|---|---|---|---|
| 1,246,709 | 11/1917 | Brown | 182/204 |
| 2,049,594 | 8/1936 | Stultz | 312/128 |
| 2,937,765 | 5/1960 | Shank | 108/143 |
| 3,221,677 | 12/1965 | Kerr | 108/143 X |
| 3,528,558 | 9/1970 | Williams . | |
| 3,908,832 | 9/1975 | Marshall . | |
| 4,084,703 | 4/1978 | Hossalla et al. | 108/137 X |
| 4,589,349 | 5/1986 | Gebhardt et al. | 108/137 X |
| 4,620,489 | 11/1986 | Albano | 108/143 X |
| 4,660,477 | 4/1987 | Kortering et al. | 108/137 X |
| 5,673,801 | 10/1997 | Markson | 211/59.3 |
| 5,720,230 | 2/1998 | Mansfield | 108/143 X |

*Primary Examiner*—Daniel P. Stodola
*Assistant Examiner*—Gregory J. Strimbu
*Attorney, Agent, or Firm*—Donald R. Fraser

[57] ABSTRACT

A shelf assembly for displaying produce such as prepackaged salads wherein the shelf assembly includes at least two panels and two telescoping arms. The panels are movably supported by the arms with one of the panels at least partially overlapping the other panel. Each of the panels is provided with a plurality of spaced apart apertures extending therethrough. When the panels are arranged to overlap one another, the apertures in the panels align with one another to permit air to circulate therethrough.

5 Claims, 3 Drawing Sheets

EXTENSIBLE DISPLAY SHELF

BACKGROUND OF THE INVENTION

The invention generally relates to display shelves and more particularly to extensible shelves for displaying produce such as prepackaged salads, for example.

The display of prepackaged salads in the typical supermarkets produce department poses a number of problems for the store managers. Amongst the problems is to display the packages of produce in a pleasing and sales appealing manner within a commercially expedient amount of space. Further, since prepackaged salads must be maintained at a constant temperature within a very narrow temperature range, care must be given to the selection of appropriate temperature sensitive shelving.

Known shelving systems do not completely embrace the characteristics suitable for shelving, maintaining, and displaying prepackaged salads. Accordingly, it is a desideratum of the present invention to produce a shelving structure capable of overcoming the deficiencies of the prior art.

SUMMARY OF THE INVENTION

The present invention is directed to a shelving structure having considerable flexibility to be arranged in a plurality of configurations which may be quickly and easily assembled without the requirement of special tools.

It is another objective of the invention to produce a unique shelving structure which is adaptable with most upright and wall-type cases of the type used in the produce, dairy, deli, or juice departments of supermarkets.

Another object of the invention is to produce a display shelving structure which is capable of baffling air over and around the product being displayed such as prepackaged salads to militate against the shrinkage of the product and extends to the normal shelf-life of the product.

Still another object of the invention is to produce a display type shelving system which is extensible and adjustable in respect of the depth of the supporting surface.

The above objects and advantages of the invention may typically be achieved by an extensible display shelf assembly for a display stand comprising at least a pair of spaced apart arms, each of the arms having a first end affixable to a vertically extending support, a second end, and means for selectively adjusting the distance between the first end and the second end; a first extended surface panel having spaced apart side edges supported by arms, the panel having an array of apertures formed to extend therethrough; and a second extended surface panel having spaced apart side edges adapted to overlap a portion of and extend downwardly adjacent and parallel to the respective side edges of the first panel, the side edges provided with means for fastening the side edge of the second panel to the second end of the arms, the second panel being supported by the arms and the first panel and having an array of apertures formed to extend therethrough and alienable with apertures in said first panel to permit the circulation of air therethrough.

BRIEF DESCRIPTION OF THE DRAWINGS

The above as well as other objects of the invention will become readily apparent to one skilled in the art from reading the following detailed description of the preferred embodiment of the invention when considered in the light of the accompanying drawings, in which.

DETAILED DESCRIPTION OF THE PREFERRED EMBODIMENT

Figure 1:
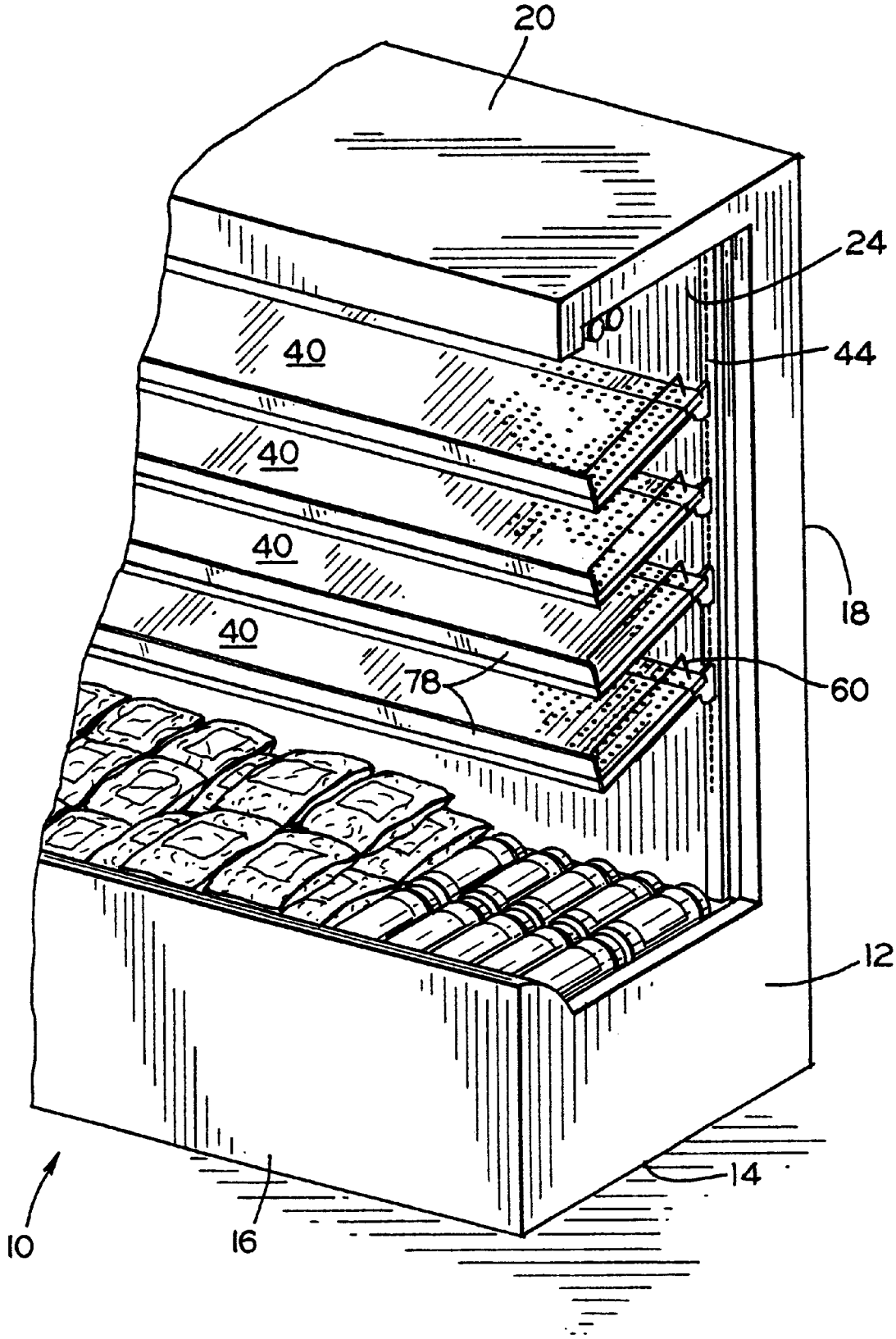
FIG. 1 is a fragmentary perspective view of shelving system for the support and display of produce such as prepackaged salads wherein the shelves embody the features of the invention.
Figure 2:
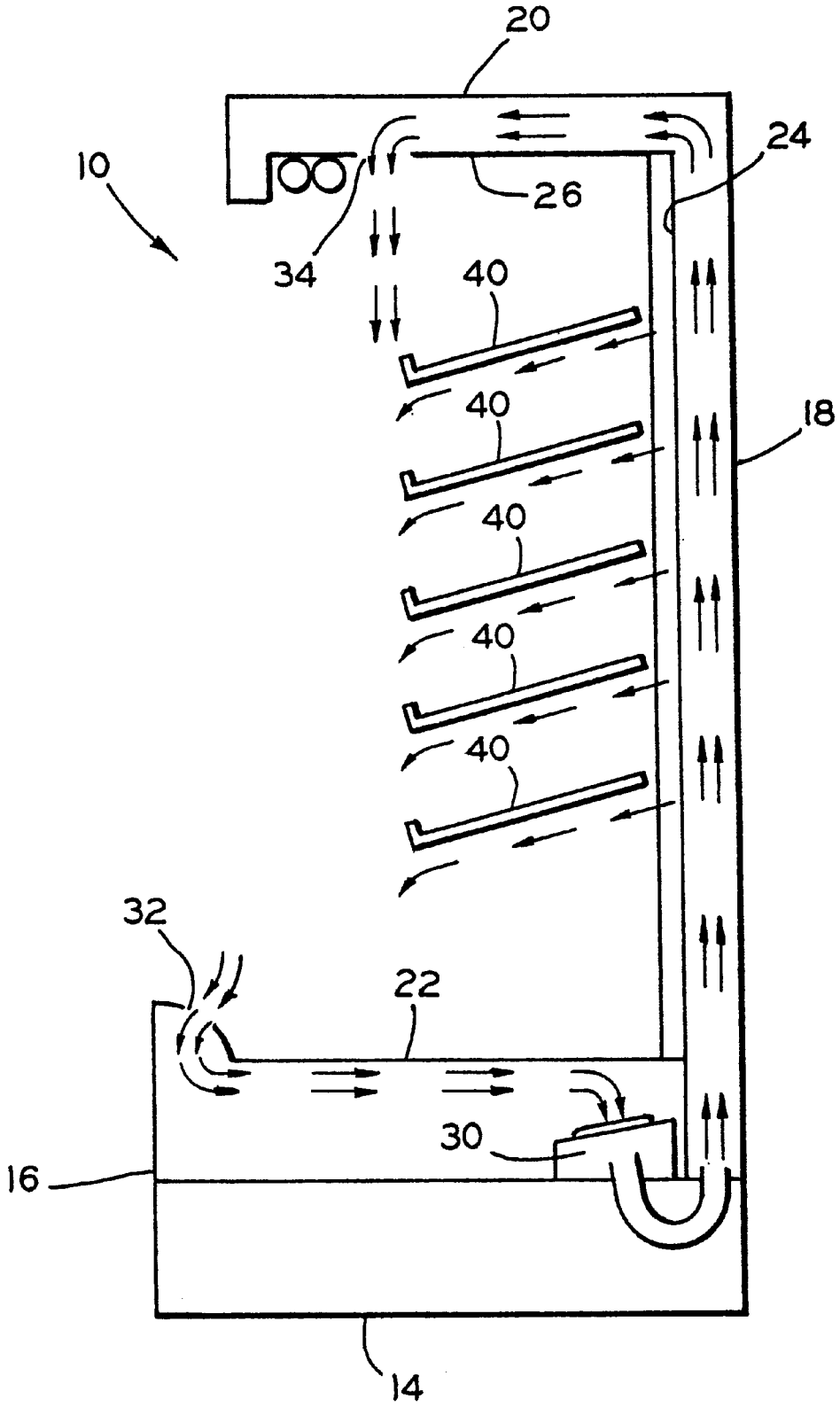
FIG. 2 is a side elevational view of the shelving system illustrated in FIG. 1.
Figure 3:
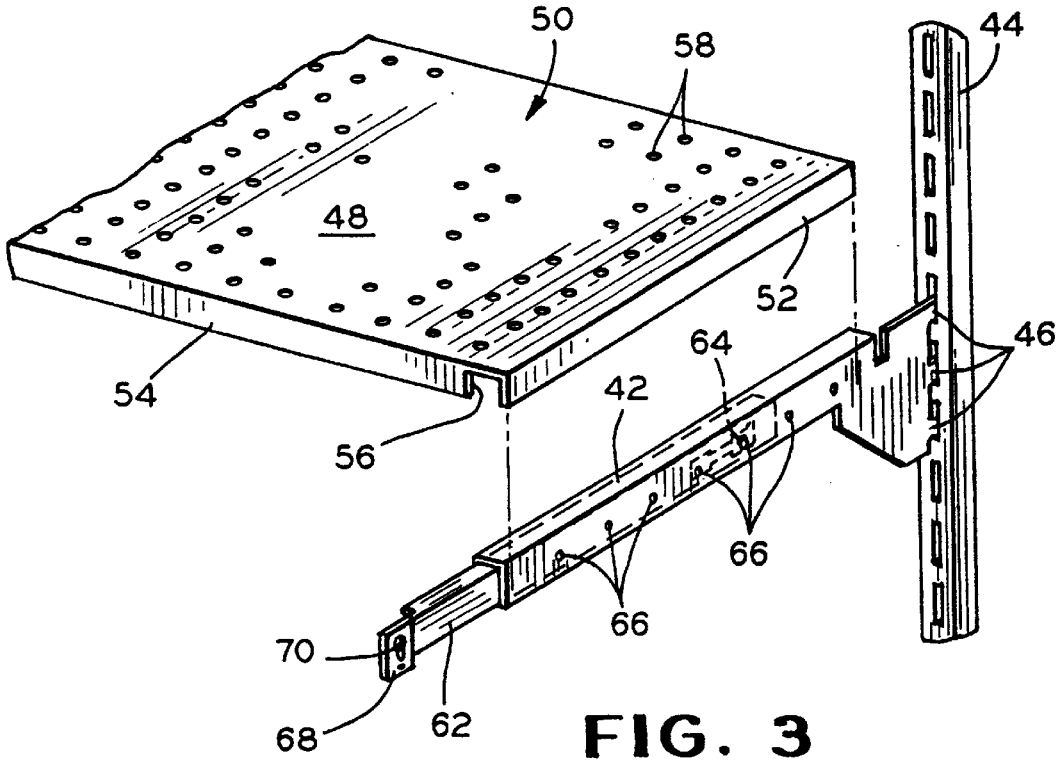
FIG. 3 is a fragmentary exploded view of a portion of the shelves of the invention.

Referring to the drawings wherein like reference numerals designate similar parts throughout, there is illustrated in FIGS. 1 and 2 an upright display stand structure 10 including an outer wall system being spaced apart end walls 12, only one of which is illustrated, a base wall 14, a front wall 16, a rear wall 18, and a top wall 20.

The stand structure 10 also includes an inner wall system spaced from the above mentioned outer wall system. The inner wall system includes a bottom wall 22, an upstanding rear wall 24 and a top wall 26.

The spaced relation between inner and outer walls of the display stand 10 produces a confined zone for conducting and guiding the flow of air. Circulation of the air within the zone is maintained by a fan 30 which is capable of causing air to be introduced to the zone through an inlet 32. The incoming air tends to travel along the under surface of bottom wall 22 and then upwardly within the zone defined by the rear walls 18 and 24. And finally the circulating air is directed to an outlet 34 through the zone defined by the spaced apart top walls 20 and 26. The air which is existed through the outlet 34 is then directed to flow over and around the product being displayed on the shelving of the invention. The shelving of the invention is illustrated in FIGS. 1 and 2 as a stacked array of spaced apart shelves 40 which are mounted to extend at an angle from the rear wall 24.

The individual shelves 40 are supported by extensible bracket arms 42 which individually are secured to vertically extending spaced apart uprights 44. The bracket arms 42 are provided with outwardly extending teeth 46 adapted to be received in slots formed in the uprights 44. The teeth 46 are so shaped to enable the bracket arms 42 to be mounted at different predetermined angles with respect to the rear wall 24.

The shelves 40 are comprised of a shelf 48 typically formed from a sheet metal panel having an upper supporting surface 50, downturned side edges 52, and downturned front edge 54. The front edge 54 is formed to provide a notch 56. The upper supporting surface 50 is provided with a plurality of apertures 58 which are provided for a multitude of purposes. The apertures 58 function to permit the circulation of air, as will be explained in more detail hereinafter, and also to receive the downward depending legs of product stop members 60 as illustrated in FIG. 1.

The bracket arm 42 includes an extension 62 which is adapted to be telescopingly received with the bracket arm 42. As illustrated in FIG. 1, the extension 62 includes a spring detent 64 which is urged into selective engagement with one of a linear array holes 66 in the side of the bracket arm 42. In assembling the shelving system of the invention, the extension 62 is adjusted to the desired depth of the shelf by pushing the detent 64 through the holes 66 and moving the extension 62 in or out. The arm extension 62 includes an attachment 68 having a "key hole" type aperture 70 formed therein.

Next, a shelf 72 is positioned over the shelf 48. The shelf 72 is typically formed from a sheet metal panel having a supporting surface 74, downturned side edges 76, and a longitudinally extending, vertically disposed front sign channel 78, and an extruded rivet 80. Once the shelf 72 is in the desired position, the rivet 80 is offered up to and positioned within the aperture 70, thereby locking the shelf 74 to the extension 62 of the bracket arm 42.

It will be noted that the supporting surface 74 is provided with a plurality of apertures 82 arrayed in such a manner to align with the apertures 58 formed in the surface 50 of the shelf 48.

Figure 4:
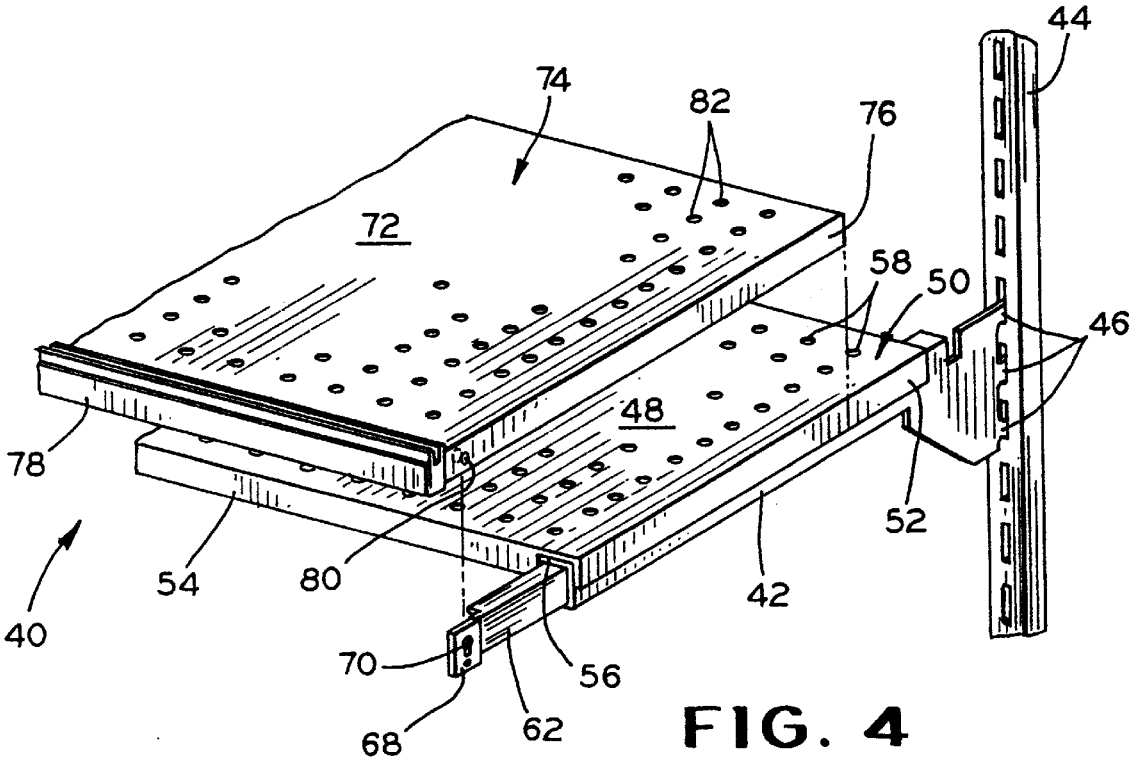
FIG. 4 is a fragmentary exploded view of a portion of the shelves of the invention showing the upper shelf prior to being finally placed in operative position.

In the assembled form, as illustrated in FIG. 4, the apertures 58, 82 of the shelves 48, 72, respectively, are in general alignment. The alignment of these apertures enables the circulation of air therethrough and thence through the supported produce. With the advent of prepackaged salads, it is of paramount importance to militate against the occurrence of "hot spots" within the produce. Many of the prepackaged salads need to be maintained at a temperature within the range of from about 38° F. to 42° F. to maximize the shelf life of the produce. The present invention readily enables the desired temperature range to be achieved without the presence of any undesirable "hot spots".

A typical display stand is illustrated in FIGS. 1 and 2 wherein air of the desired temperature is caused to be circulated. The air is typically forced through the system by a suitably disposed fan 30. The air tends to flow from the inlet 32 along the under surface of the bottom wall 22 and then upwardly through the zone defined by the spaced apart rear walls 18 and 24. The air is caused to travel to the outlet 34 through a zone defined by the spaced apart top walls 20 and 26. The exiting air is then caused to travel generally downwardly. The downward travel is caused by the fact the air exiting the outlet 34, while having absorbed some heat energy, is cooler than the ambient air. Also, the continuous partial vacuum caused by the fan 30 tends to pull the air downwardly and into the inlet 32.

It will be noted that the downwardly flowing air tends to bathe the shelves 40 and travels downwardly through the multitude of apertures 58, 82 found in the shelves 48, 72, respectively. In the regions of the shelves where the shelf sections overlap one another, the air passes through the aligned apertures 58, 82.

It will be appreciated that while the above described shelving system is particularly suited to display prepackaged salads, many other produce and products may be satisfactorily and advantageously displayed.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. An extensible display shelf assembly for a display stand comprising:

at least a pair of support arms spaced apart from one another, each of said arms having a first end affixable to vertically extending support means, a second end, and means for selectively adjusting a spacing between the first end and the second end;

a first extended surface panel having side edges spaced apart from one another and directly supported by said arms, said panel having an array of apertures formed to extend therethrough; and a second extended surface panel having side edges spaced apart from one another and adapted to overlap a portion of and extend downwardly adjacent and parallel to the side edges of said first panel, at least one of the side edges of said second panel provided with means for directly fastening the at least one of the side edges of said second panel to the second end of a respective one of said arms, said second panel being supported by said arms and said first panel and having an array of apertures formed to extend therethrough and alignable with said apertures in said first panel to permit circulation of air therethrough.

2. The shelf assembly defined in claim 1 wherein said means for directly fastening the at least one of the side edges of said second panel to the second end of the respective one of said arms includes a bracket extending outwardly from the second end of the respective one of said arms having an aperture therein and a detent affixed to said second panel which interconnects with said bracket.

3. The shelf assembly defined in claim 1 wherein each one of said arms includes first and second telescoping members.

4. The shelf assembly defined in claim 3 wherein said first members include the first ends and said second members include the second ends.

5. The shelf assembly defined in claim 4 wherein said means for selectively adjusting the spacing between the first end and the second end of each of said arms includes a spring detent.

* * * * *